US005444474A

United States Patent [19]

Ohtsubo et al.

[11] Patent Number: 5,444,474

[45] Date of Patent: Aug. 22, 1995

[54] INK-JET CARTRIDGE FOR INK-JET PRINTERS AND INK-JET PRINTER USING THE SAME

[75] Inventors: Kazumi Ohtsubo, Kurume; Mitsuhide Matsuda, Fukuoka; Yutaka Miyazono, Kasuga; Hideaki Horio, Fukuoka, all of Japan

[73] Assignee: Matsushita Electric Industrial Co., Ltd., Osaka, Japan

[21] Appl. No.: 34,857

[22] Filed: Mar. 19, 1993

[30] Foreign Application Priority Data

Mar. 23, 1992 [JP] Japan ..... 4-064501
Mar. 23, 1992 [JP] Japan ..... 4-064515

[51] Int. Cl.[6] ..... B41J 2/175; B41J 2/165

[52] U.S. Cl. ..... 347/87; 347/29; 347/33; 347/44

[58] Field of Search ..... 346/140 R, 145; B41J 2/165, 2/175; 347/22, 29, 33, 34, 36, 44, 84, 86, 87

[56] References Cited

U.S. PATENT DOCUMENTS 4,371,881 2/1983 Bork et al. ..... 346/140 R
4,450,454 5/1984 Koto ..... 346/140 R
4,500,894 2/1985 Kirner ..... 346/140 R
4,578,686 3/1986 Vollert ..... 346/140 R
4,771,295 9/1988 Baker et al. ..... 346/140 R X
4,935,751 6/1990 Hamlin ..... 346/140 R
5,105,210 4/1992 Hirano et al. ..... 346/145

FOREIGN PATENT DOCUMENTS 4101695 8/1992 Germany ..... B41J 2/165
60-757871 8/1985 Japan .
63-87242 4/1988 Japan .

*Primary Examiner*—Benjamin R. Fuller
*Assistant Examiner*—Alrick Bobb
*Attorney, Agent, or Firm*—Pollock, Vande Sande & Priddy

[57] ABSTRACT

An ink-jet cartridge for ink-jet printers includes a nozzle-cleaning mechanism built in the cartridge itself for removing residual ink and foreign matter, such as dust and dirt including paper powder, from nozzles. Since the built-in nozzle-cleaning mechanism is replaced automatically when the cartridge is replaced, and since the replacement of the cartridge generally takes place before the nozzle-cleaning mechanism deteriorates mainly due to contamination with ink, the nozzles are always kept clean and a reliable printing operation with high quality printing is insured throughout the service life of the cartridge.

5 Claims, 10 Drawing Sheets

INK-JET CARTRIDGE FOR INK-JET PRINTERS AND INK-JET PRINTER USING THE SAME

BACKGROUND OF THE INVENTION

1. Field of the Invention

The present invention relates to an ink-jet cartridge containing an ink case and adapted to be used with an ink-jet printer constructed to provide a printed record of the computer output information by ejecting tiny droplets of ink onto the surface of a recording medium such as plain paper. The invention also relates to an ink-jet printer using such ink-jet cartridge.

2. Description of the Prior Art

In recent years, computers have become smaller (downsized, as we generally say), as exhibited by the development of a lap-top model replacing the desk-top model, followed by the development of a book-size or a note-size model replacing the lap-top model. With this downsizing trend in computer design, the portability and the downsizing have become major requirements for printers which are used in combination with the computers. Under these circumstances, an intense interest has been shown toward a disposable type ink-jet cartridge because this cartridge is convenient for application to the computers of lap-top size, book-size and note-size due to its noticeable usability and compactness.

FIG. 8 of the accompanying drawings shows, in exploded perspective view, the general construction of a conventional ink-jet cartridge 1.

The conventional ink-jet cartridge 1 generally comprises a housing 2 forming a body of the ink-jet cartridge 1, an ink-jet print head 3 having an ink-ejecting means composed of a plurality of nozzles (ink ejection orifices) 4 arranged in a predetermined matrix pattern, an ink-holding means or member 5 made of a porous material, such as sponge, for holding therein an ink 6 to be ejected from the nozzles 4, and an end plug 7 fitted with an open end of the housing 2 to hold the ink holding means 5 within the housing 2 under a compressed condition between the housing 2 and the end plug 7. The print head 3 further has an electric connector means 8 which supplies the print head 3 with the necessary electric energy for enabling the print head 3 to eject the ink 6 from the nozzles 4. The housing 2 has a plurality of ink flow passages 9 through which the ink 6 flows from the ink-holding means 5 to the print head 3. A filter 10 is disposed between the ink-holding means 5 and the ink flow passages 9 to remove air bubbles and a foreign matter, such as dust and dirt, when the ink 6 passes through the filter 10.

Referring now to FIG. 9, there is shown a portion of an ink-jet printer 11 including a carriage 12 in which the ink-jet cartridge 1 shown in FIG. 8 is mounted. The printer 11 also includes a wiper blade 13 made of rubber, for example, for wiping or cleaning a front surface of the print head 3 at which the front ends (discharge ends) of the respective nozzles 4 open, a blade support member 14 for supporting the wiper blade 13, a waste ink reservoir 15 for receiving and storing the waste ink, and a nozzle cap 16 for closing the nozzles 4. The wiper blade 13, blade support member 14, waste ink reservoir 15 and cap 16 are all provided on a body of the ink-jet printer 11. As shown in FIGS. 10 and 11, the printer 11 further includes a platen 17 against which a recording paper 18 is pressed by a presser plate 19. The platen 17 is rotated by a suitable drive means (not shown) in the direction of the arrow A on FIG. 11, so that the recording paper 18 is advanced in response to a rotary motion of the platen 17. In FIGS. 10 and 11, numeral 20 depicts a residual ink which remains on the front surface of the print head 3 in the vicinity of the nozzles 4 after the ejection is completed. The residual ink 20 will cause a certain problem described later on.

The conventional ink-jet cartridge 1 of the foregoing construction operates as follows.

As shown in FIG. 11, the ink 6 held in the ink-holding means 5 passes by the capillary force through the filter 10 during which time air bubbles and a foreign matter, such as dirt and dust, are removed from the ink 6. Then, the ink 6 flows from the ink flow passages 9 into the nozzles 4 in the print head 3 and reaches to the front ends of the respective nozzles 4. While keeping this condition, an electric energy is supplied to the electric connector means 8 (FIG. 8) whereupon a suitable ejection energy exerting means, such as an electric-to-thermal energy conversion element, associated with the print head 3 converts the electric energy to a thermal energy and, thereby, heats the ink 6 to such an extent as to cause a phase change which will rapidly increase the pressure of a portion of the ink 6. A sudden pressure rise thus created produces an ejection energy large enough to eject tiny droplets of ink 6 from the nozzles 4. By virtue of a negative pressure produced on ejection of the ink 6, the nozzles 4 are automatically filled with a new supply of ink 6 in the same manner as described above, thus completing preparations for the next printing operation. The ink 6 ejected from the nozzles 4 adheres to the surface of the recording paper 18 carried on the platen 17 so as to provide a printed record of information on the recording paper 18. The carriage 12 (FIG. 9) of the ink-jet printer 11 is driven to reciprocate the ink-jet cartridge 1 along the platen 17 to print an entire line at a time.

However, when the tiny droplets of ink are ejected from the nozzles 4, a very small amount of ink 6 adheres to the front surface of the print head 3 in the vicinity of the front ends of the respective nozzles 4. As the printing operation is repeated, the ink adhering to the front surface of the print head 3 grows gradually and eventually forms a mass of ink (residual ink) 20 deposited on the front surface of the print head 3. The residual ink 20 is likely to contaminate or stain the recording paper 18 and tends to change the direction of ejection of the ink 6 with the result that the printing qualities are significantly deteriorated. In addition, while the printer is not used, a volatile solvent contained in the ink 6.becomes vapor. As a result, that portion of the ink 6 held within the nozzles 4 becomes thick or sticky and hence is likely to adhere to the inside surface of the nozzles 4, thereby narrowing the nozzles 4. The nozzles 4 are, therefore, unable to eject the ink 6 with reliability and an ejection failure is thus brought about. A similar ejection failure will occur when a nozzle 4 is clogged with paper powder or any other foreign matter which is generated during printing operation.

To eliminate the foregoing difficulties (viz., the deterioration of printing qualities and the occurrence of an ejection failure caused by a substance adhering to the front surface of the print head 3 in the vicinity of the front ends of the respective nozzles 4), when either the power of the ink-jet printer 11 is turned on or off, or when the ink-Jet printer 11 completes printing operation for several sheets of recording paper 18, the carriage 12 shown in FIG. 9 is driven to traverse the ink-jet cartridge 1 along the platen 17 such that the print head 3 moves across the wiper blade 13, as shown in FIGS. 12A and 12B. With this movement of the print head 3 relative to the wiper blade 13, any substance, such as a residual ink 20, dust and dirt including paper powder remaining on the front surface of the print head 3, is wiped off or removed and then collected in the waste ink reservoir 15. Thus, the front surface of the print head 3 and the front ends of the respective nozzles 4 are cleaned. When the ink-jet printer 11 is not used, the carriage 12 is disposed in a position in which the nozzles 4 are covered by the nozzle cap 16.

The foregoing attempt of the prior art arrangement is still unsatisfactory in that since the wiper blade 13 and the waste ink reservoir 15 are disposed on the body of the ink-jet printer 11, the ink-jet printer 11 is filled up with the waste ink during a continuous use of the ink-jet printer 11. Once the waste ink reservoir 15 becomes full, a following print-head cleaning operation will result in contamination of the wiper blade 13 with a residual ink and dust and dirt. When wiped with the thus contaminated wiper blade 13, the front surface of the print head 3 is necessarily contaminated too. Most likely that the nozzles 4 are narrowed by the residual ink 20 and foreign matters, such as dirt and dust including paper powder, which adhere to the front surface of the print head 3 in the vicinity of the front ends of the respective nozzles 4. A reliable printing operation is therefore difficult to achieve and the printing qualities are deteriorated greatly. Furthermore, the cap of the nozzle is likely to catch a foreign matter, such as paper powder, during a continuous use of the ink-jet printer 11. The foreign matter will prohibit the nozzle cap from sealing the nozzles 4 perfectly. With this imperfect sealing, a volatile solvent contained in the ink 6 becomes vaporized through the nozzles 4 and, hence, that portion of the ink 6 held within the nozzles 4 becomes thick or sticky, adhering to the inside surface of the nozzles 4. Thus, the nozzles 4 again suffer from a clogging problem.

SUMMARY OF THE INVENTION

With the foregoing drawbacks of the prior art in view, it is a general object of the present invention to provide an ink-jet cartridge for ink-jet printers which enables an ink-jet printer to perform a reliable printing operation with high printing qualities.

A more specific object of the present invention is to provide an ink-jet cartridge incorporating structural features which are able to prevent the occurrence of an ejection failure caused mainly by a residual ink and a foreign matter remaining on the front surface of a print head in the vicinity of nozzles.

A further object of the present invention is to provide an ink-jet cartridge for ink-jet printers which is compact in size and hence is able to reduce the entire size of an ink-jet printer.

Another object of the present invention is to provide an ink-jet printer which is used with the ink-jet cartridge and particularly suitable for use with a small-sized computer, such as a lap-top computer or a book-size computer.

An ink-jet cartridge according to this invention includes: a case containing therein an ink; a plurality of nozzles formed in the case for ejecting the ink, each of the nozzles having a discharge end opening at a surface of the case; and wiper means, movably mounted on the case and slidable along the surface of the case, for wiping the surface to clean up the discharge end of each of the nozzles.

Preferably, the wiper means is mounted on a shutter so as to move together with the shutter. The shutter is slidably mounted on the case and reciprocally movable along the surface of the case to open and close the discharge end of each of the nozzles. The wiper means wipes the surface of the case while the shutter reciprocates along the surface of the case.

The ink-jet cartridge may further include a porous ink-absorbing member mounted in the case and having a surface lying flush with, or projecting slightly from, the surface of the case. The wiper means is slidably engageable with the surface of the ink-absorbing member so that a residual ink remaining on the surface of the case in the vicinity of the nozzles is wiped off from the surface of the case and then forced onto the surface of the ink-absorbing member which in turn absorbs the residual ink.

Preferably, the wiper means is used in combination with a nozzle cap which is mounted on the shutter to seal the discharge end of each of the nozzles when the shutter is disposed in a closed position.

Many other advantages, features and additional objects of the present invention will become manifest to those versed in the art upon making reference to the detailed description and accompanying sheets of drawings in which preferred structural embodiments incorporating the principles of the present invention are shown by way of illustrative examples.

DETAILED DESCRIPTION OF THE INVENTION

Figure 1:
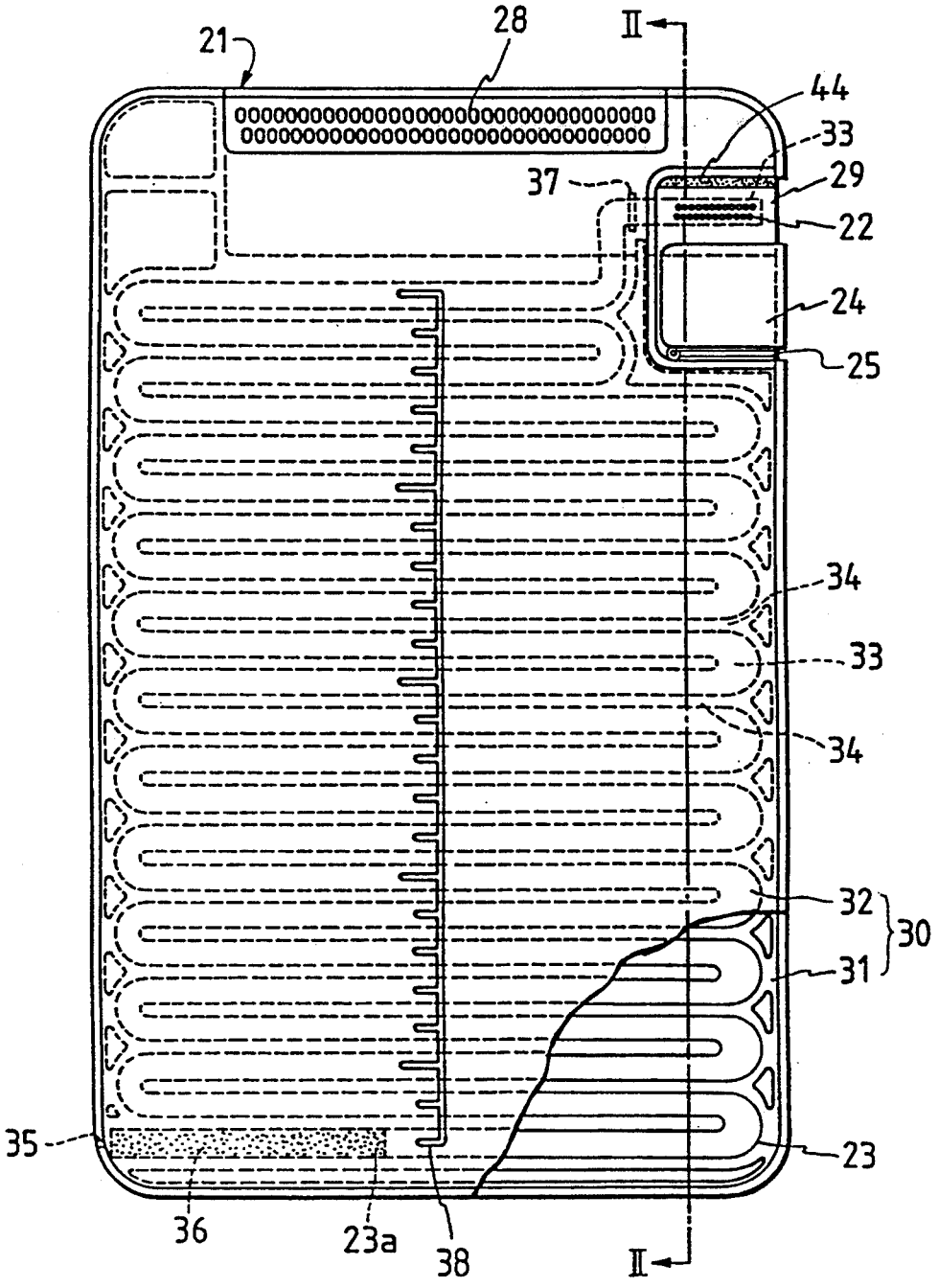
FIG. 1 is a schematic plan view, with parts cutaway for clarity, of an ink-jet cartridge according to one embodiment of the present invention.

Certain preferred embodiments of the present invention will be described in greater detail with reference to FIGS. 1 through 8 of the accompanying drawings, wherein like reference characters designate like or corresponding parts throughout the several views.

Figure 2:
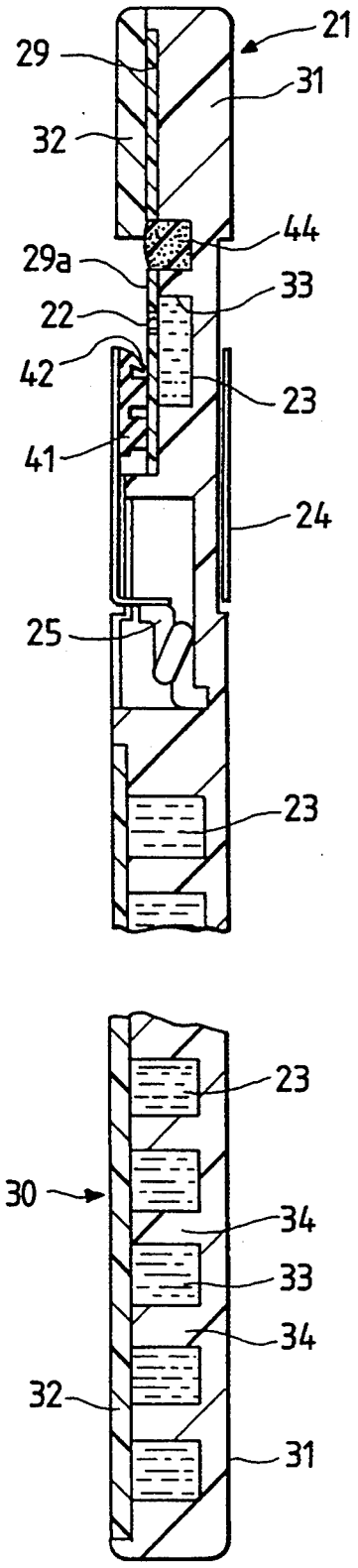
FIG. 2 is a cross-sectional view taken along the line II—II of FIG. 1.
Figure 3:
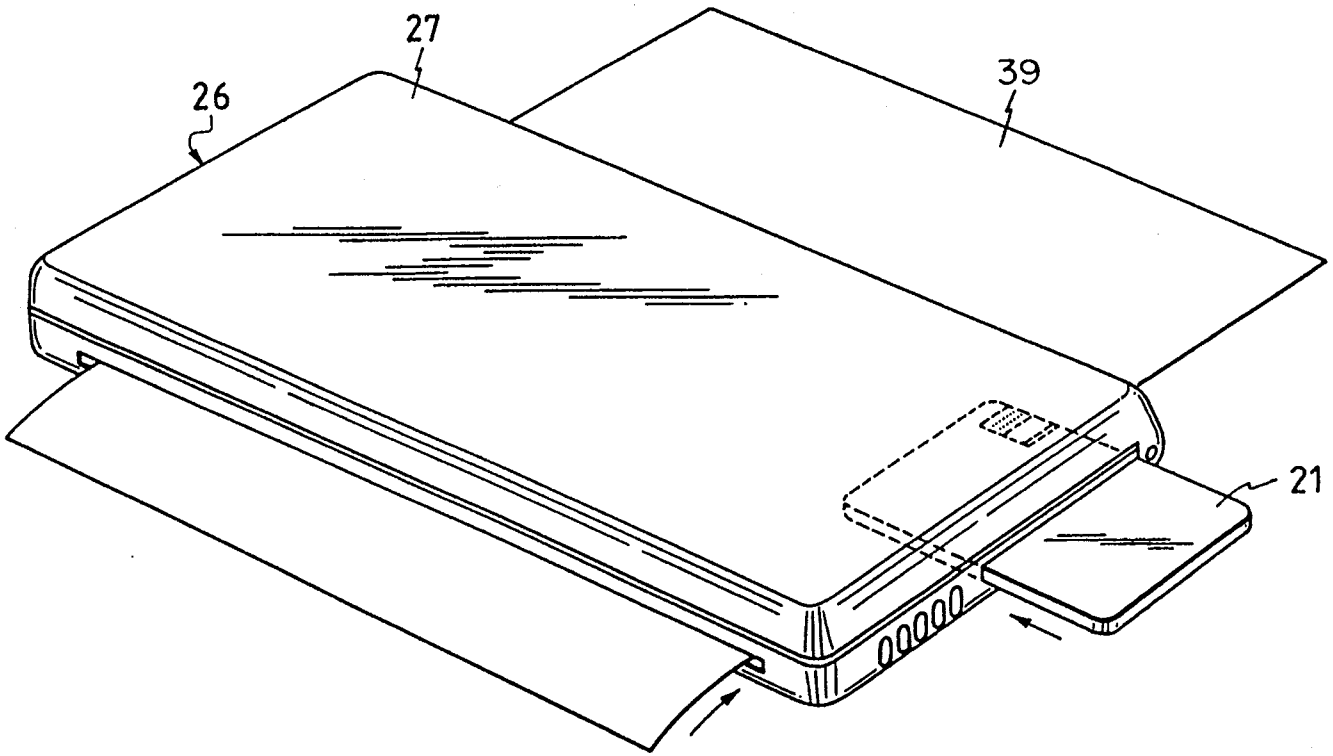
FIG. 3 is a perspective view of a ink-jet printer in which the ink-jet cartridge shown in FIG. 1 is used.

FIGS. 1 and 2 show an ink-jet cartridge 21 according to one embodiment of the present invention. The ink-jet cartridge 21 has a flat, rectangular card-like shape and includes a plurality of nozzles (ink ejection orifices) 22 arranged in a predetermined matrix pattern for ejecting streams of ink 23. Each of the nozzles 22 has a heater (not shown) built therein. A slide shutter 24 is slidably mounted on one side of the ink-jet cartridge 21 for a purpose of preventing the ink 23 from leaking through the nozzles 22 either in the liquid state or in the vapor state, and for a purpose of protecting the nozzles 22 against a clogging problem. The slide shutter 24 is preferably made of a light metal such as stainless steel, or a synthetic resin which is highly resistant to chemical attack and has a sufficient stiffness. The slide shutter 24 is urged in one direction by means of a suitable urging means such as a spring 25, so that the nozzles 22 are normally closed by the slide shutter 24. The slide shutter 24 is opened by means of a suitable shutter-opening means, such as a solenoid actuator (not shown) which is mounted in an ink-jet printer 26 (FIG. 3). The solenoid actuator is activated to open the slide shutter 24 when the ink-jet cartridge 21 is attached to a body 27 (FIG. 3) of the ink-jet printer 26, or immediately before the ink-jet printer 26 is started to begin its printing operation. An electric connector means 28 transmits an electric signal from the body 27 of the ink-jet printer 26 to an ink-ejecting means (not shown) provided within each of the nozzles 22. The nozzles 22 and their respective ink-ejecting means, and the electric connector means 28 are integrally formed on a print head substrate 29. The print head substrate 29 has a front surface 29a (FIG. 2) at which the front ends (discharge ends) of the respective nozzles 22 open. The print head substrate 29 is preferably made of an engineering plastics which is highly resistant to chemical attack and has a sufficient stiffness.

The ink-jet cartridge 21 also includes a substantially rectangular container or case 30. The case 30 is composed of a case body 31 and a case cover 32 joined together, with the print head substrate 29 firmly gripped between the case body 31 and the case cover 32, as shown in FIG. 2. The front surface 29a of the print head substrate 29 lies flush with a mating surface between the case body 31 and the case cover 32. The front surface 29*a* thus arranged forms a portion of a surface of the case 30 at which the front ends (discharge ends) of the respective nozzles 22 open.

The case body 31 is made preferably of a transparent engineering plastic, such as modified polyphenylene oxide or polyethylene terphthalate, which is highly resistant to chemical attack and has a sufficient stiffness. The case body 31 has an ink-holding portion 33 formed therein. The case cover 32 is preferably made of a transparent, chemical-resistant synthetic resin such as polyimide. The case cover 32 is attached by adhesive bonding, for example, to the case body 31 so as to close the ink-holding portion 33. The ink-holding portion 33 is filled with the ink 23. The ink-holding portion 33 comprises a single elongated ink-flow passage along which the ink 23 is fed toward the nozzles 22. The ink-flow passage 33 is defined by a plurality of parallel spaced partition walls or ribs 34 formed integrally with the case body 31. The ink-flow passage (ink-holding portion) 33 has a uniform cross-sectional shape and extends zigzag or meanderingly along a major axis of the rectangular case 30, as shown in FIG. 1. The ink-flow passage 33 has one end (leading end) connected to the nozzles 22, the opposite end (trailing end) of the ink-flow passage 33 communicating with the atmosphere via a vent hole 35 (FIG. 1) which is formed in the case body 31 to equalize the pressure inside the ink-flow passage 33 with the atmospheric pressure. In order to prevent the reverse flow of the ink 23, a suitable seal member 36 (FIG. 1) is disposed at the trailing end of the ink-flow passage 33. The seal member 36 is preferably made of a porous material. The porous seal member 36 may be replaced by silicone oil.

It will be appreciated that the ribs 34 provided to define the zigzag ink-flow passage (ink-holding portion) 33 serve as a reinforcing member. Thus, the case 30 having such a zigzag ink-flow passage 33 (or reinforced by the ribs 34) is rigid and hence is highly resistant to deformation or bending. It is, therefore, possible to prevent the occurrence of a sealing failure (ink leakage) which would otherwise be caused due to bending or deformation of the case 30 when the ink-jet cartridge 21 is subjected to an external force. The case 30 of the foregoing construction provides a substantial reduction in thickness of the ink-jet cartridge 21 which will lead to a reduction in size of the ink-jet printer 26.

A filter 37 (FIG. 1) is disposed between the ink-holding portion 33 and the nozzles 22 for removing air bubbles and a foreign matter, such as dust and dirt, from the ink 23. The transparent case 30 has a scale 38 (FIG. 1) provided by printing, for example, on an outside surface of the case cover 32 for enabling the user to determine quantitatively the amount of ink 23 remaining within the ink-jet cartridge 21.

Figure 11:
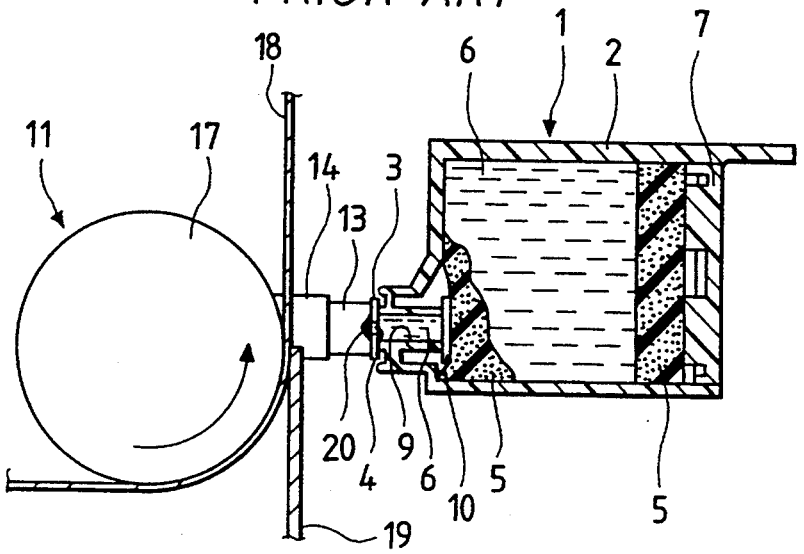
FIG. 11 PRIOR ART
FIG. 11 is a cross-sectional view of FIG. 10.
Figure 12A:
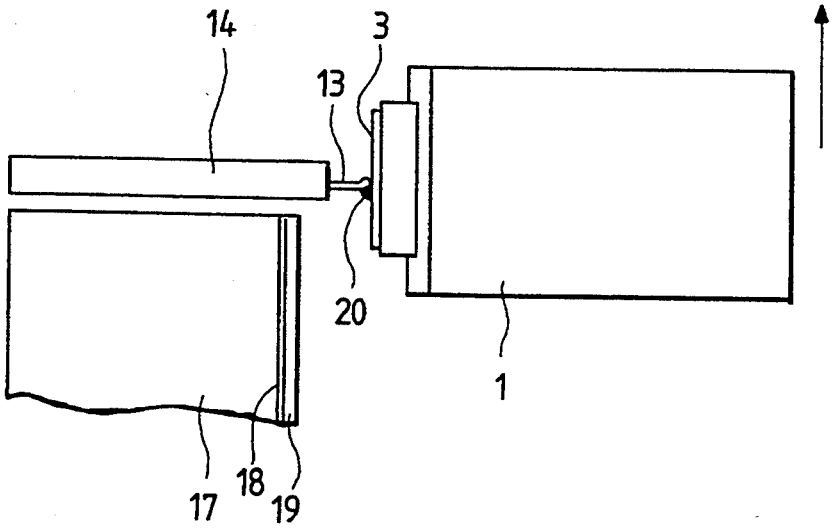
FIG. 12A PRIOR ART
FIGS. 12A and 12B are plan views illustrative of the manner in which a print head of the conventional ink-jet cartridge is cleaned.
Figure 12B:
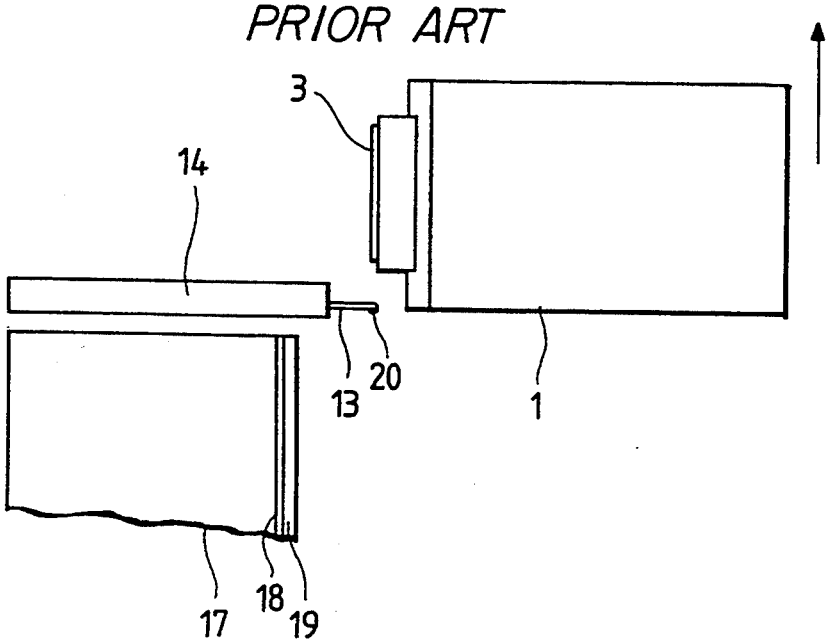
FIG. 12B PRIOR ART

In use, the ink-jet cartridge 21 of the foregoing construction is installed in the ink-jet printer 26, as illustrated in FIG. 3. In this figure, reference numeral 39 designates a recording paper held against the outer surface of a cylindrical platen (not shown but substantially identical to the platen 17 shown FIG. 11).

Printing operation of the ink-jet printer 26 will be described below with reference to FIGS. 1 through 3.

The ink-jet cartridge 21 is attached to the printer body 27 whereupon the electric connector means 28 is connected to an electric energy supplying means (not shown) of the printer body 27, and the slide shutter 24 is opened by means of a suitable shutter-opening means, such as a solenoid actuator (not shown), provided on the printer body 27. The ink 23 held within the ink-holding portion (ink-flow passage) 33 passes by the capillary force through the filter 37 during which time air bubbles and a foreign matter, such as dirt and dust, are removed from the ink 23. Then, the ink 23 flows into the nozzles 22 and reaches to the front ends (discharge ends) of-the respective nozzles 22. While keeping this condition, the printer body 27 supplies a print signal to the ink-jet cartridge 21 via the electric connector means 28 whereupon the non-illustrate built-in heaters of the respective nozzles 22 are activated to cause a portion of the ink 23 to become evaporated and cause trapped air bubbles to expand rapidly. The trapped air bubbles thus creates a sudden pressure rise and thereby forces the ink 23 out from the nozzles 22.

The ink 23 sprayed from the nozzles 22 adheres to the surface of the recording paper 39 (FIG. 3) so as to provide a printed record of information accordance to the print signal. The ink-jet cartridge 21 is movable in a direction perpendicular to the direction of feed of the recording paper 39 so that a single full line is printed as the ink-jet cartridge 21 completes the movement in said direction. Then, the recording paper 39 is fed by a predetermined pitch in the direction of the arrow shown in FIG. 3, and after that the next full line is printed by the ink-jet cartridge 21.

In the embodiment described above, the ink-ejecting means is composed of a built-in heater associated with each of the nozzles 22. This is to be construed as illustrative rather than restrictive. The heater may be replaced by any other suitable ink-ejection means or system. One example of such ink-ejection system is that an electric current is passed directly through a conductive ink to heat the ink so that a portion of the ink is vaporized and trapped air bubbles produces a sudden pressure rise, forcing the ink 23 out from the nozzles. Another suitable ink-ejection system may be of the type using a piezoelectric element which has the ability to produce a mechanical force due to its deformation when a voltage is applied. The mechanical force thus produced is directly exerted on the ink to expel the ink from the nozzles.

Upon ejection of the ink 23, there is produced a negative pressure or vacuum within the ink-holding portion 33. The negative pressure thus produced creates a suction force acting in a direction toward the nozzles 22, so that the nozzles 22 are automatically filled with a new supply of the ink 23 fed by the action of the negative pressure. Since the case 30 is transparent, the user is readily able to determine the current amount of ink 23 held within the case 30 by visually observing the position of a trailing end 23*a* (FIG. 1) of the ink 23 through the transparent case 30. In this instance, by using the scale 38 on the case 30, the amount of ink 23 remaining within the case 30 can be determined quantitatively.

Figure 4:
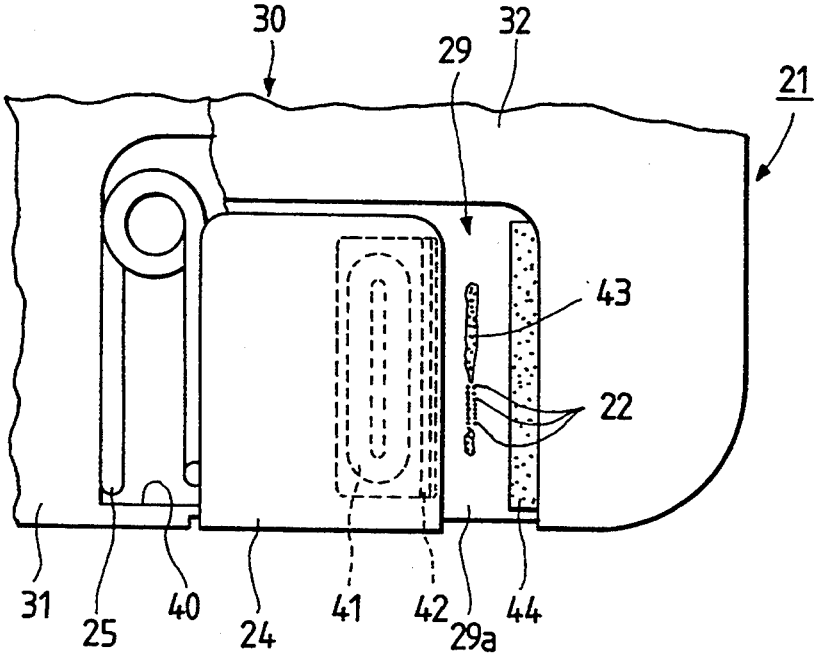
FIG. 4 is an enlarged plan view of a portion of the ink-jet cartridge.
Figure 5A:
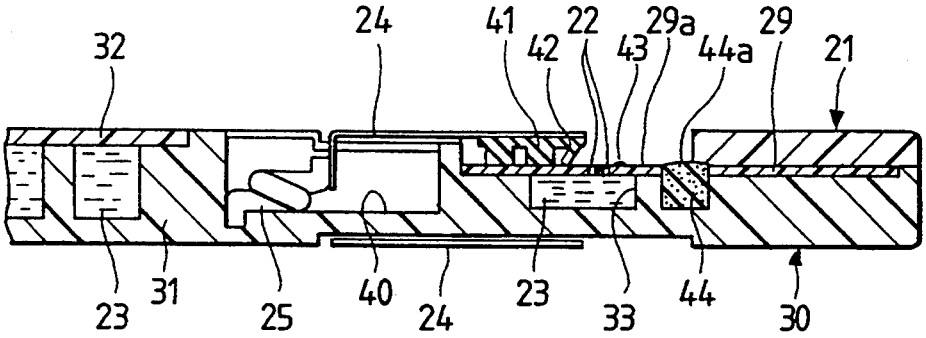
FIGS. 5A through 5C are cross-sectional views of the ink-jet cartridge, showing the manner in which discharge ends of the respective nozzles are cleaned.
Figure 5B:
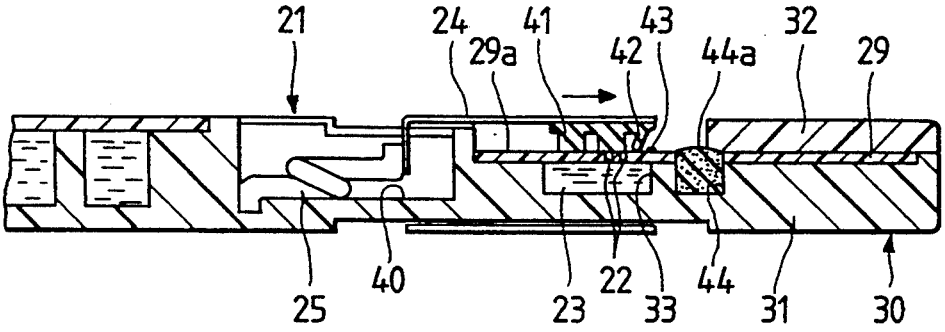
Figure 5C:
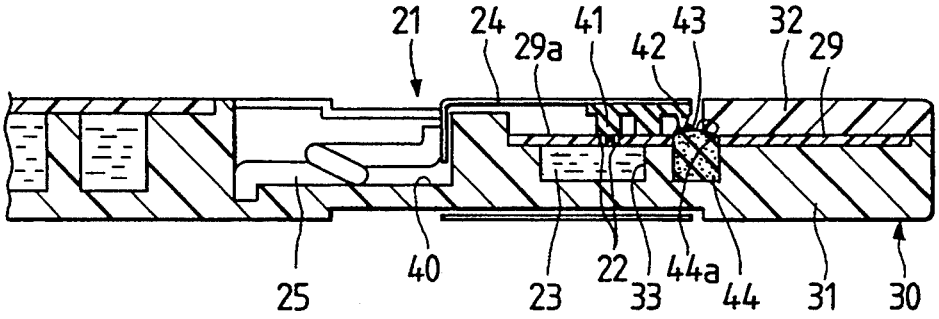

Referring now to FIG. 4, there is shown in plan view a portion of the ink-jet cartridge 21 just described above. In this figure, the ink-jet cartridge 21 is shown with the slide shutter 24 disposed in an open position. In this position, the spring 25 used for urging the slide shutter 24 in the closed position is fully distorted. The spring 25 is composed of a torsion spring retained within a recess 40 formed in the case body 31. The slide shutter 24 includes a nozzle cap 41 attached by adhesive bonding, for example, to the underside (inside surface) of the slide shutter 24 to seal off the nozzles 22 when the slide shutter 24 is disposed in the closed position. The nozzle cap 41 is preferably made of an elastic material such as rubber. The slide shutter 24 further has a wiper means 42 provided for wiping off a residual ink 43 and a foreign matter adhering to the front surface 29*a* of the print head substrate 29 in the vicinity of the front ends of the respective nozzles 22. The wiper means 42 comprises a wiper blade formed integrally with the nozzle cap 41 as a portion of the nozzle cap 41 which extends along a front edge of the slide shutter 24. A residual ink absorbing member 44 made of a porous material, such as an open-cell polyurethane foam, is embedded in the case body 31 for absorbing a residual ink 43 which has been wiped off from the front surface 29*a* of the print head substrate 29. As shown in FIG. 5A–5C, the residual ink absorbing member 44 has a convex surface 44a projecting slightly from the front surface 29*a* of the print head substrate 29. The convex surface 44a is advantageous in that a positive pressure contact can be established between the wiper blade 42 and the waste ink absorbing member 44. The convex surface 44*a* may be replaced with a flat surface lying substantially flush with, or slightly projecting from, the front surface 29*a* of the print head substrate 29.

Hereinafter will be described a manner in which the front ends of the nozzles 22 of the ink-jet cartridge 21 are wiped or cleaned. As previously mentioned, either when the ink-jet cartridge 21 is attached to the printer body 27 (FIG. 3), or immediately before the ink-jet printer 26 is started to commence its printing operation, the non-illustrated actuator of the printer body 27 is driven to open the slide Shutter 24 of the ink-jet cartridge 21 against the force of the spring 25, as shown in FIG. 5A. Then, the ink 23 is ejected from the nozzles 22 to print an entire line. When the ink 23 is ejected from the nozzles 22 in the form of tiny droplets, a very small amount of ink 23 adheres to the front surface 29*a* of the print head substrate 29 in the vicinity of the front ends of the respective nozzles 22. As the printing operation is repeated, the ink adhering to the front surface 29*a* grows gradually and eventually forms a mass of ink (residual ink) 43 deposited on the front surface 29*a* of the print head substrate 29 mostly in the vicinity of the front ends of the nozzles 22.

When printing operation for one line completes, the actuator releases the slide shutter 24 whereupon the slide shutter 24 starts moving in a direction indicated by the arrow on FIG. 5B. As the slide shutter 24 advances, the wiper blade 42 wipes up the front surface 29*a* of the print head substrate 29 to remove the residual ink 43 and any foreign matter, such as dirt and dust, from the front surface 29*a*, thereby cleaning up the front ends of the respective nozzles 22. The residual ink 43 and the foreign matter are then forced toward the residual ink absorbing member 44. Thereafter, the slide shutter 24 arrives at its closed position shown in FIG. 5C. In this instance, the wiper blade 42 is held in pressure contact with the convex surface 44*a* of the porous residual ink absorbing member 44, so that the residual ink 43 is absorbed in the porous residual ink absorbing member 44 by the capillary action. At the same time, the nozzles 22 are covered and sealed by the nozzle cap 41.

Figure 9:
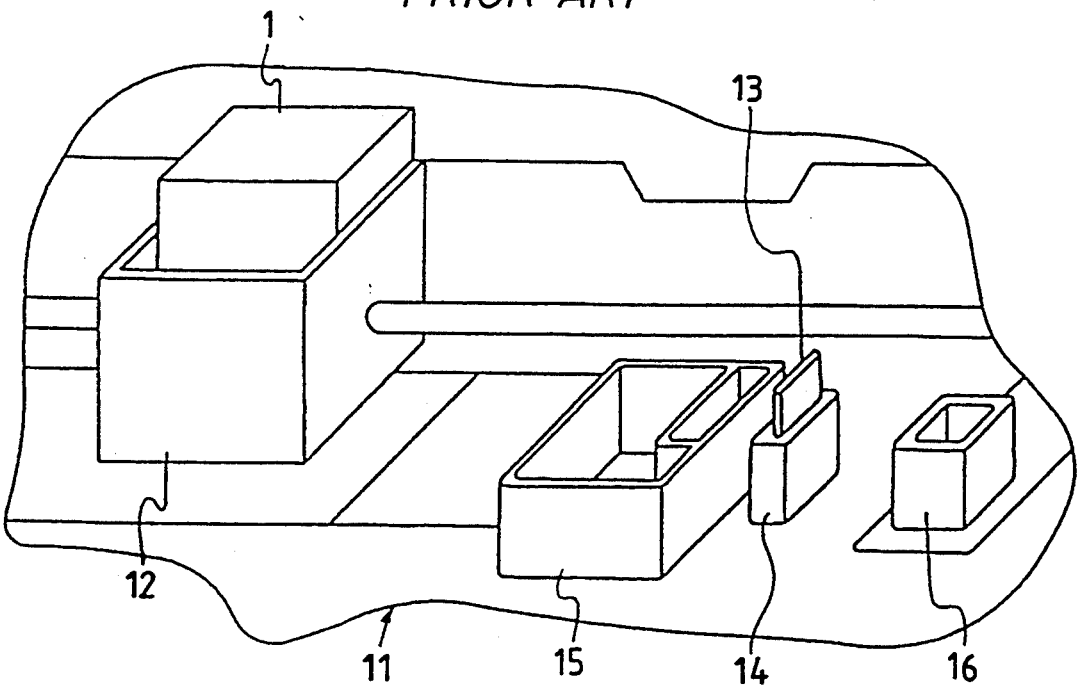
FIG. 9 PRIOR ART
FIG. 9 is a perspective view showing the construction of a portion of an ink-jet printer in which the conventional ink-jet cartridge is installed.
Figure 10:
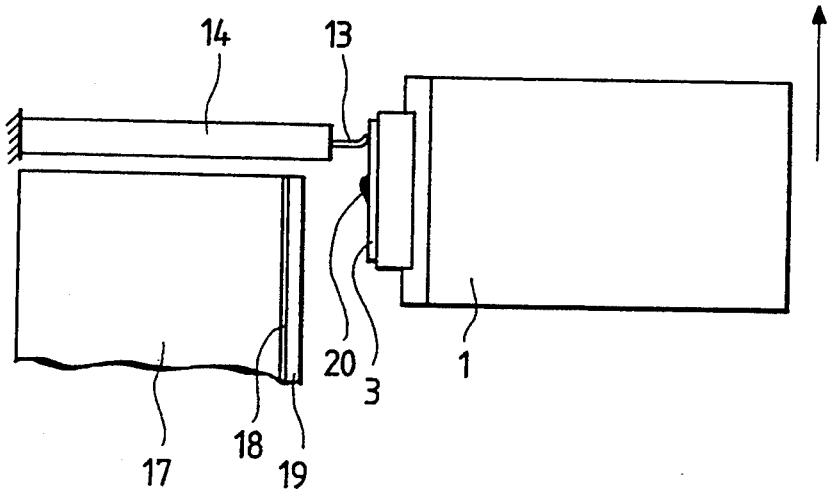
FIG. 10 PRIOR ART
FIG. 10 is a plan view showing the conventional ink-jet cartridge and related parts of the printer.

Unlike the prior art arrangement shown in FIG. 9, the ink-jet cartridge 21 of this invention is provided with a wiper blade 42 for wiping off a residual ink 43 and any foreign matter, a residual ink absorbing member 44 for absorbing the residual ink 43, and a nozzle cap 41 for sealing the nozzles 22. The ink-jet cartridge 21 thus constructed is able to keep the nozzles 22 and print head substrate 29 free from contamination and clogging by using its own component parts 41, 42 and 44, without relying upon comparable components 16, 14 and 15 provided on the ink-jet printer 11 shown in FIG. 9. The ink-jet printer 26 which is used with the ink-jet cartridge 21 does not require the components 14–16 specified above and, hence, can be constructed more compactly than the ink-jet printer 11 in which the conventional ink-jet cartridge 1 is used, as shown in FIG. 9. In addition, the nozzles 22 are normally closed by the nozzle cap 41, so that a foreign matter is unable to enter the nozzles 22, and the ink 23 in the case 30 is prevented from getting dry. The ink-jet cartridge 21 is substantially free from a nozzle clogging problem and, hence, is able to perform a reliable printing operation with high printing qualities. Furthermore, a nozzle-cleaning mechanism (viz., the nozzle cap 41, the wiper blade 42, and the waste ink absorbing member 44) is of the built-in type and hence can be replaced automatically when the ink-jet cartridge 21 is replaced. The use of such a built-in nozzle-cleaning mechanism frees the user from a maintenance work which is required when he uses the conventional nozzle cleaning mechanism shown in FIG. 9.

Figure 6A:
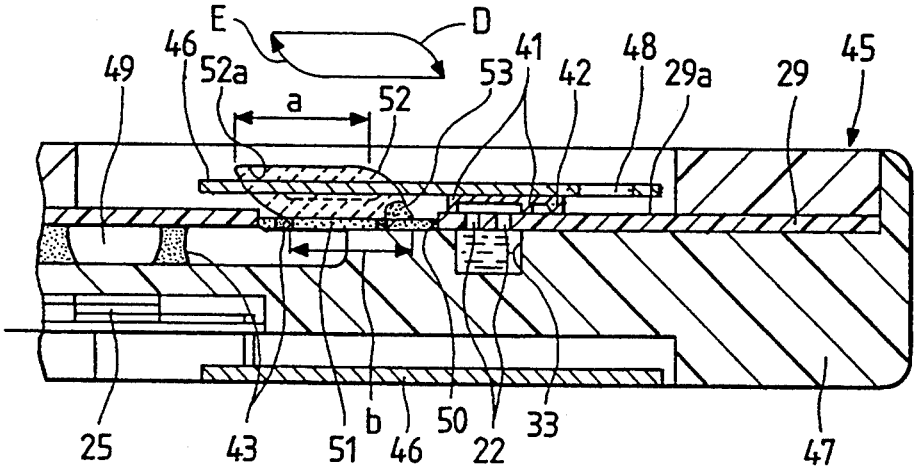
FIGS. 6A and 6B are enlarged cross-sectional views illustrative of a nozzle-cleaning operation of a modified ink-jet cartridge.

Then, a further embodiment of the present invention will be described below with reference to FIGS. 6A and 6B and FIG. 7. In FIG. 6A, the ink-jet cartridge 45 is shown with a slide shutter 46 in the open position comparable to the position of FIG. 5A for the first embodiment.

One difference between the ink-jet cartridge 45 of FIG. 6A and the first embodiment is that the slide shutter 46 slidably mounted on a case 47 has an elongated rectangular opening or window 48 (best shown in FIG. 7) which is disposed in registry with the position of the nozzles 22 when the slide shutter 46 is opened. The slide shutter 46 is preferably made of a light metal, such as stainless steel, or a synthetic resin which is highly resistant to chemical attack and corrosion and has a sufficient stiffness.

A second difference in the embodiment shown in FIG. 6A is that the case 47 has a waste ink return passage 49 for collecting a waste ink (residual ink) and then returning the same to an ink-holding portion 33 of the case 47 (Though not shown in FIG. 6A, but as understood from FIG. 1, the ink-holding portion 33 is composed of a zigzag ink-flow passage.). To this end, one end of the waste ink return passage 49 communicates with an end (trailing end) of the ink-holding portion 33 remove from the nozzles 22. The opposite end of the waste ink return passage 49 is connected to an opening 50 formed in the print head substrate 29 adjacent the nozzles 22. A waste ink absorbing member 51 made of a porous material, such as an open-cell urethane foam, is fitted in the opening 50 to close the opposite end of the waste ink return passage 49.

A third but the last difference in the embodiment shown in FIG. 6A is that the case 47 has formed therein a guide recess 52 (illustrated by hatching for clarity), and the slide shutter 46 has a guide wing or projection 53 movably received in the guide recess 52 and slidable along a peripheral surface (cam surface) 52a of the guide recess 52. As shown in FIG. 6A, the peripheral surface (cam surface) **52*a* of the guide recess 52 is profiled to define a rhomboid, and the guide recess 52 has a substantially rhomboidal shape, accordingly. The rhomboid-shaped guide recess 52 serves as a cam, while the guide wing 53 serves as a cam follower. The slide shutter 46 is normally urged to the closed position by means of the spring 25, so that the guide wing 53 is normally disposed at a lower left corner of the rhomboid-shaped guide recess 52 which is located close to the nozzles 22, as shown in FIG. 6A. By the use of the rhomboid-shaped guide recess (cam) 52 in combination with the guide wing (cam follower) 53, the slide shutter 46 is movable toward and away from the front surface 29*a* of the print head substrate 29 while reciprocating along the front surface 29*a* between the closed position (FIG. 6A) and the open position (FIG. 6B). Likewise the first embodiment, the slide shutter 46 is provided with a nozzle cap 41 and a wiper blade 42 which are integral with each other and attached to the backside (inside surface) of the slide shutter 46 for the same purpose as described above. When the slide shutter 46 is disposed in the closed position, the nozzle cap 41 and the wiper blade 42 are held in contact with the front surface 29*a* of the print head substrate 29, with the nozzles 22 sealed by the nozzle cap 41**, as shown in FIG. 6A.

Operation of the ink-jet cartridge 45 will be described below in conjunction with the movement of the slide shutter 46.

In a normal condition, or when the ink-jet printer 26 is not used, the slide shutter 46 is disposed in the closed position shown in FIG. 6A.

Figure 6B:
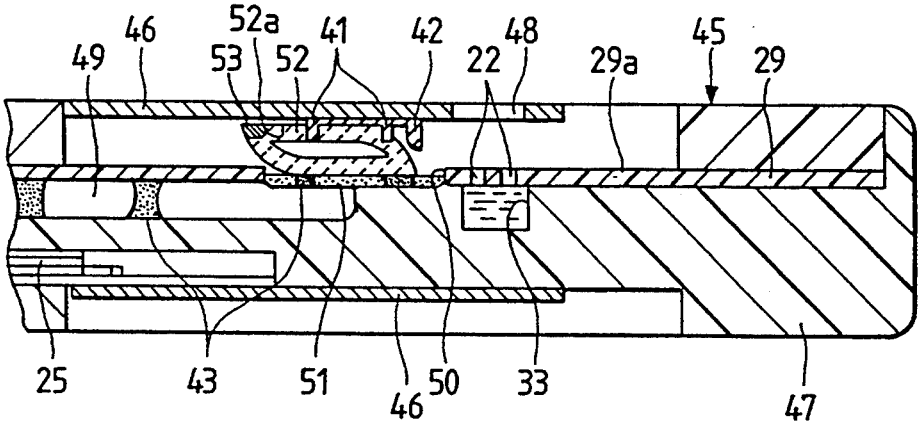
Figure 7:
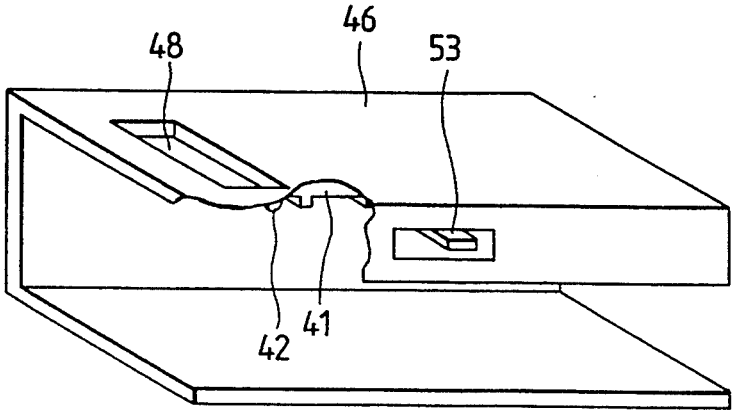
FIG. 7 is a perspective view showing a shutter of the modified ink-jet cartridge.
Figure 8:
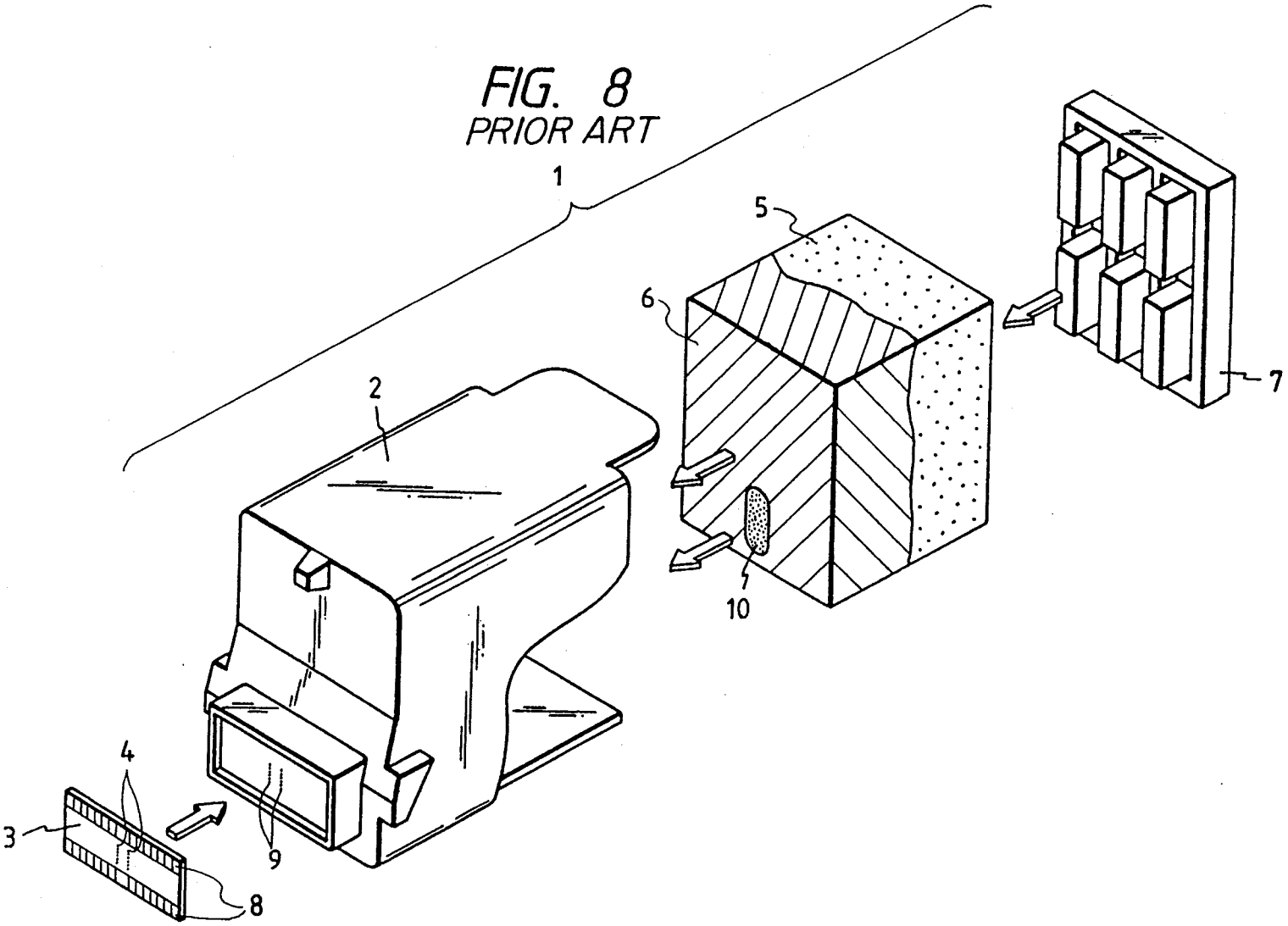
FIG. 8 PRIOR ART
FIG. 8 is an exploded perspective view, with parts cutaway for clarity, of a conventional ink-jet cartridge.

Before a printing operation begins, the slide shutter 46 is displaced in a direction of the arrow E on FIG. 6A by means of the non-illustrated shutter opening means or actuator of the printer body 27 (FIG. 3) until the slide shutter 46 arrives at the open position shown in FIG. 6B. During that time, the guide wing 53 slides leftwards in FIG. 6A along a flat lower side of the rhomboid-shaped guide recess 52, then goes up along an oblique left side of the rhomboid-shaped guide recess 52, and finally stops at an upper left corner of the rhomboid-shaped guide recess 52. As the guide wing 53 advances along the flat lower side of the rhomboid-shaped guide recess 52 (distance "b" on FIG. 6A), the nozzle cap 41 and the wiper blade 42 slide along the front surface **29*a* of the print head substrate 29 and then along an upper surface of the waste ink absorbing member 51. It will be understood that if there is a residual ink and a foreign matter, such as dust and dirt, adhering to the front surface 29*a* in the vicinity of the nozzles 22, and if the wiper blade 42 moves in the manner just described above, the wiper blade 42 will wipe off the residual ink and the foreign matter from the front surface 29*a* and then gather them onto the waste ink absorbing member 51. The residual ink (designated by 43 in FIG. 6A) is absorbed by the waste ink absorbing member 51 by the capillary action, as shown in FIG. 6A. Thereafter, as the guide wing 53 goes up along the oblique left side of the rhomboid-shaped guide recess 52, the nozzle cap 41 and the wiper blade 42 separate from the front surface 29*a* and the waste ink absorbing member 51 and move upwards as shown in FIG, 6B. When the slide shutter 46 is open, the window 48 in the slide shutter 46 is held in registry with the position of the nozzles 22, so that tiny droplets of ink ejected from the nozzles 22 pass through the window 48 and adhere onto the surface of the recording paper 39 (FIG. 3**).

After the printing operation completes, the slide shutter 46 is displaced in a direction indicated by the arrow D on FIG. 6A so that it returns from the open position of FIG. 6B to the closed position shown in FIG. 6A under the force of the spring 25. During that time, the guide wing 53 of the slide shutter 46 slides rightwards in FIG. 6B along a flat upper side of the rhomboid-shaped guide recess 52, then goes down along an oblique right side of the rhomboid-shaped guide recess 52, and finally stops at a lower right corner of the rhomboid-shaped guide recess 52, as shown in FIG. 6A. As the guide wing 53 advances along the flat upper side of the rhomboid-shaped guide recess 52 (distance "a" on FIG. 6A), the nozzle cap 41 and the wiper blade 42 are held out of contact with the front surface **29*a* of the print head substrate 29 and the outside surface of the waste ink absorbing member 51. Thereafter, as the guide wing 28 goes down along the oblique right side of the rhomboid-shaped guide recess 52, the nozzle cap 41 and the wiper blade 42 approach the front surface 29*a* of the print head substrate 29. When the guide wing 53 arrives at the lower right corner of the rhomboid-shaped guide recess 52, the nozzle cap 41 and the wiper blade 42 are again brought into contact with the front surface 29*a* of the print head substrate 29, with the nozzles 22 covered by the nozzle cap 41. The nozzle cap 41 prevents the ink 23** from leaking out from the nozzles 22 either in the liquid phase or in the gaseous phase and also protects the nozzles 22 against contamination with a foreign matter, such as dust and dirt including paper powder, which comes mainly from the recording paper 39 (FIG. 3). The nozzles 22 are, therefore, free from a clogging problem.

The residual ink 43 held within the waste ink absorbing member 51 is sucked, as a waste ink, into the waste ink return passage 49 by virtue of a negative pressure created within the ink-holding portion 33 when the ejection is performed. As the amount of ink 23 remaining within the ink-holding portion 33 reduces, the waste ink 43 is drawn from the waste ink return passage 49 into the ink-holding portion 33 under the action of the vacuum created within the ink-holding portion 33. Within the ink-holding portion 33, the waste ink 43 follows the trailing end 23*a* (see FIG. 1) of the ink 23, but the ink 23 and the waste ink 44 are separated from one another by a suitable seal such as silicone oil (not shown).

In the second embodiment just described above, during one cycle of reciprocation of the slide shutter 46, the wiper blade 42 is held in sliding contact with the front surface 29*a* of the print head substrate 29 only when it goes across the nozzles 22 in one direction toward the waste ink absorbing member 51. To the contrary, the wiper blade 42 is held out of contact with the front surface 29*a* of the print head substrate 29 when it goes across the nozzles 22 in the opposite direction away from the waste ink absorbing member 51. With this controlled movement of the wiper blade 42, the residual ink 43 remaining on the front surface 29*a* in the vicinity of the nozzles 22 is wiped off from the front surface 29*a* and then gathered onto the waste ink absorbing member 51. Thus, the nozzle front ends are kept always clean.

It is possible, according to the present invention, to replace the rhomboid-shaped guide recess 52 with a plate cam (not shown) which is disposed on, or formed integrally with, the front surface 29*a* of the print head substrate 29 for causing the slide shutter 46 to move in the same manner as described above. To this end, the plate cam has a properly profiled cam surface for guiding therealong a cam follower member (viz. the guide wing 53, for example) of the slide shutter 46. In addition, if it is anticipated that the residual ink 43 can spread only within a range of movement of the nozzle cap 41, the wiper blade 42 may be omitted. In this case, the nozzle cap 41 doubles in function as a seal cap and a wiper blade.

Obviously, various minor changes and modifications of the present invention are possible in the light of the above teaching. It is therefore to be understood that within the scope of the appended claims the invention may be practiced otherwise than as specifically described.

What is claimed is:

1. An ink-jet cartridge comprising:

(a) a case containing therein an ink and having a surface;

(b) a plurality of nozzles formed in said case for ejecting said ink held within said case, each of said nozzles having a discharge end opening at said surface of said case;

(c) an ink-absorbing member made of a porous material disposed in said case, said ink-absorbing member having a surface projecting slightly from, said surface of said case;

(d) a shutter slidably mounted on said case and reciprocally movable along said surface of said case to open and close said discharge end of each of said nozzles; and (e) wiper means, mounted on and movable with said shutter, for wiping said surface of said case to clean said discharge end of each of said nozzles, said wiper means being movable across said discharge end of each of said nozzles and engageable with said surface of said ink-absorbing member while said shutter reciprocates along said surface of said case;

wherein said surface of said ink-absorbing member is a convex surface slightly projecting from said surface of said case.

2. An ink-jet cartridge according to claim 1, wherein said wiper means comprises a wiper blade made of an elastic material.

3. An ink-jet cartridge comprising:

(a) a case containing therein an ink and having a surface;

(b) a plurality of nozzles formed in said case for ejecting said ink held within said case, each of said nozzles having a discharge end opening at said surface of said case;

(c) an ink-absorbing member made of a porous material disposed in said case, said ink-absorbing member having a surface lying flush with, or projecting slightly from, said surface of said case;

(d) a shutter slidably mounted on said case and reciprocally movable along said surface of said case to open and close said discharge end of each of said nozzles; and (e) wiper means, mounted on and movable with said shutter, for wiping said surface of said case to clean said discharge end of each of said nozzles, said wiper means being movable across said discharge end of each of said nozzles and engageable with said surface of said ink-absorbing member while said shutter reciprocates along said surface of said case;

wherein said case has defined therein an ink-holding portion for holding said ink and a waste ink return passage, said ink-holding portion having a first end and a second end remote from said first end, said first end of said ink-holding portion being connected with said nozzles, said waste ink return passage having a first end and a second end remote from said first end, said first end of said waste ink return passage being connected with said porous ink-absorbing member, said second end of said waste ink return passage being connected with said second end of said ink-holding portion.

4. An ink-jet cartridge comprising:

(a) a case having an ink-holding portion defined therein for holding an ink, said case further having a surface;

(b) a plurality of nozzles formed in said case for ejecting said ink held within said ink-holding portion, each of said nozzles having a discharge end opening at said surface of said case;

(c) an ink-absorbing member made of a porous material disposed in said case, said ink-absorbing member having a surface lying flush with, or projecting slightly from, said surface of said case;

(d) a shutter slidably mounted on said case and reciprocally movable along said surface of said case to open and close said discharge end of each of said nozzles; and (e) wiper means, mounted on and movable with said shutter, for wiping said surface of said case to clean said discharge end of each of said nozzles, said wiper means being movable across said discharge end of each of said nozzles and engageable with said surface of said ink-absorbing member while said shutter reciprocates along said surface of said case;

wherein said case further has a waste ink return passage defined therein, and said ink-holding portion has a first end and a second end remote from said first end, said first end of said ink-holding portion being connected with said nozzles, said waste ink return passage having a first end and a second end remote from said first end, said first end of said waste ink return passage being connected with said porous ink-absorbing member, said second end of said waste ink return passage being connected with said second end of said ink-holding portion.

5. An ink-jet cartridge comprising:

(a) a case containing therein an ink and having a surface:

(b) a plurality of nozzles formed in said case for ejecting said ink held within said case, each of said nozzles having a discharge end opening at said surface of said case;

(c) a shutter slidably mounted on said case and reciprocally movable along said surface of said case to open and close said discharge end of each of said nozzles;

(d) wiper means, mounted on and movable with said shutter, for wiping said surface of said case to clean said discharge end of each of said nozzles while said shutter reciprocates along said surface of said case;

(e) seal means, mounted on and movable with said shutter, for sealing said discharge end of each of said nozzles when said shutter is disposed in a position to close said discharge end of each of said nozzles; and (f) an ink-absorbing member made of a porous material and disposed in said case, said ink-absorbing member having a surface lying flush with, or projecting slightly from, said surface of said case, said wiper means being movable across said discharge end of each of said nozzles and engageable with said ink-absorbing member while said shutter reciprocates along said surface of said case;

wherein said case has defined therein an ink-holding portion for holding said ink and a waste ink return passage, said ink-holding portion having a first end and a second end remote from said first end, said first end of said ink-holding portion being connected with said nozzles, said waste ink return passage having a first end and a second end remote from said first end, said first end of said waste ink return passage being connected with said porous ink-absorbing member, said second end of said waste ink return passage being connected with said second end of said ink-holding portion.

* * * * *